US006643999B1

(12) United States Patent
Wheat

(10) Patent No.: US 6,643,999 B1
(45) Date of Patent: Nov. 11, 2003

(54) TRAINING HEADSTALL WITH LOOSE RIGID NOSEBAND, AND USAGE AND PRODUCTION

(76) Inventor: Rickie A. Wheat, Rte. 1, Box 510, Batesville, AR (US) 72501

( * ) Notice: Subject to any disclaimer, the term of this patent is extended or adjusted under 35 U.S.C. 154(b) by 0 days.

(21) Appl. No.: 10/325,454

(22) Filed: Dec. 20, 2002

Related U.S. Application Data

(60) Provisional application No. 60/342,660, filed on Dec. 22, 2001.

(51) Int. Cl.[7] ..... B68B 1/00
(52) U.S. Cl. ..... 54/6.1; 54/71
(58) Field of Search ..... 54/6.1, 15, 24, 54/71

(56) References Cited

U.S. PATENT DOCUMENTS 2,752,746 A * 7/1956 Swartz ..... 54/6.1
3,458,971 A * 8/1969 Stern et al. ..... 54/6.1
3,657,863 A * 4/1972 Blair ..... 54/6.1
4,583,493 A * 4/1986 Terry ..... 54/71

OTHER PUBLICATIONS

"Livestock & Equine" Mail Order Catalog, Winter Jan. 2000, pp. 41–45, (published by Jeffers, of Dothan, Alabama), relating to headgear including training headgear.

"Chick's" Mail Order Catalog, Jun. 15, 2001, pp. 2–3, 5–6, 23–24, 27–28 32, 36, 38 and 45, (by Chick's, of Harrington, Delaware), relating to headgear including halters, headstalls, bosals &C.

* cited by examiner

*Primary Examiner*—Robert P. Swiatek
(74) *Attorney, Agent, or Firm*—Jonathan A. Bay

(57) ABSTRACT

A training headstall combines headgear with a suspended rigid noseband hanging loosely encircling the horse's muzzle, being relatively free to deliver attention-getting taps. The noseband is oblong along a major axis that defines left and right halves, and has left and right eyes on opposed sides of the major axis for attachment of corresponding lines from the headgear. The headgear also has a third line that hangs down from under the horse's chin-to-throat area and attaches to a rearward portion on the noseband for imposing a measure of damping on the noseband's motion. The noseband is produced with various asymmetries such as line-eyes that are offset as referenced along the major axis in order to enhance quicker settling of the motion with the noseband so that the horse may more surely learn that this annoying if not frightening motion can be settled by stopping to a standstill.

20 Claims, 5 Drawing Sheets

22
22
56
52
44
54
56
52
24
24

44
22,12
56
52
62
58
64
28
32
34(l)
36,38
54
24
52
34(r)

TRAINING HEADSTALL WITH LOOSE RIGID NOSEBAND, AND USAGE AND PRODUCTION

CROSS-REFERENCE TO PROVISIONAL APPLICATION(S)

This application claims the benefit of U.S. Provisional Application No. 60/342,660 filed Dec. 22, 2001.

BACKGROUND AND OF THE INVENTION

The invention relates to horse-training head gear and, more particularly, to a combination of a headstall with a loose, rigid noseband the characteristics of which in regards of weight, balance and position provides distinct advantages for breaking work. Alternative aspects of the invention relate to methods of usage of the headstall and loose, weighted noseband combination for instructional use before a student audience. Still other aspects of the invention relate to a process of producing the loose, rigid noseband.

A number of additional features and objects will be apparent in connection with the following discussion of preferred embodiments and examples.

SUMMARY OF THE INVENTION

It is an object of the invention to provide horse-training head gear that shortens the ground work phase of breaking a horse to less than an hour, and more preferably still to about equal to or less than a half hour.

It is an alternate object of the invention to provide a training headstall with a loose-fitting, loosely-suspended rigid noseband the characteristics of which in regards of weight, balance and position provides distinct advantages for breaking work not just for experts but briefly trained amateurs also.

It is an additional object of the invention that the previously-mentioned loose, rigid noseband be given a construction by which its left and right lateral halves are not mirror opposites but asymmetric relative one another.

It is another object of the invention to produce instructional programs in the use of the inventive combination training headstall with a loose, rigid noseband in accordance with the invention, by which relatively-experienced instructors teach relatively-amateur students the technique(s) of its use in relatively brief sessions.

A number of additional features and objects will be apparent in connection with the following discussion of the preferred embodiments and examples with reference to the drawings.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the appended claims. In the drawings.

DETAILED DESCRIPTION OF THE PREFERRED EMBODIMENTS

Figures 1, 2:
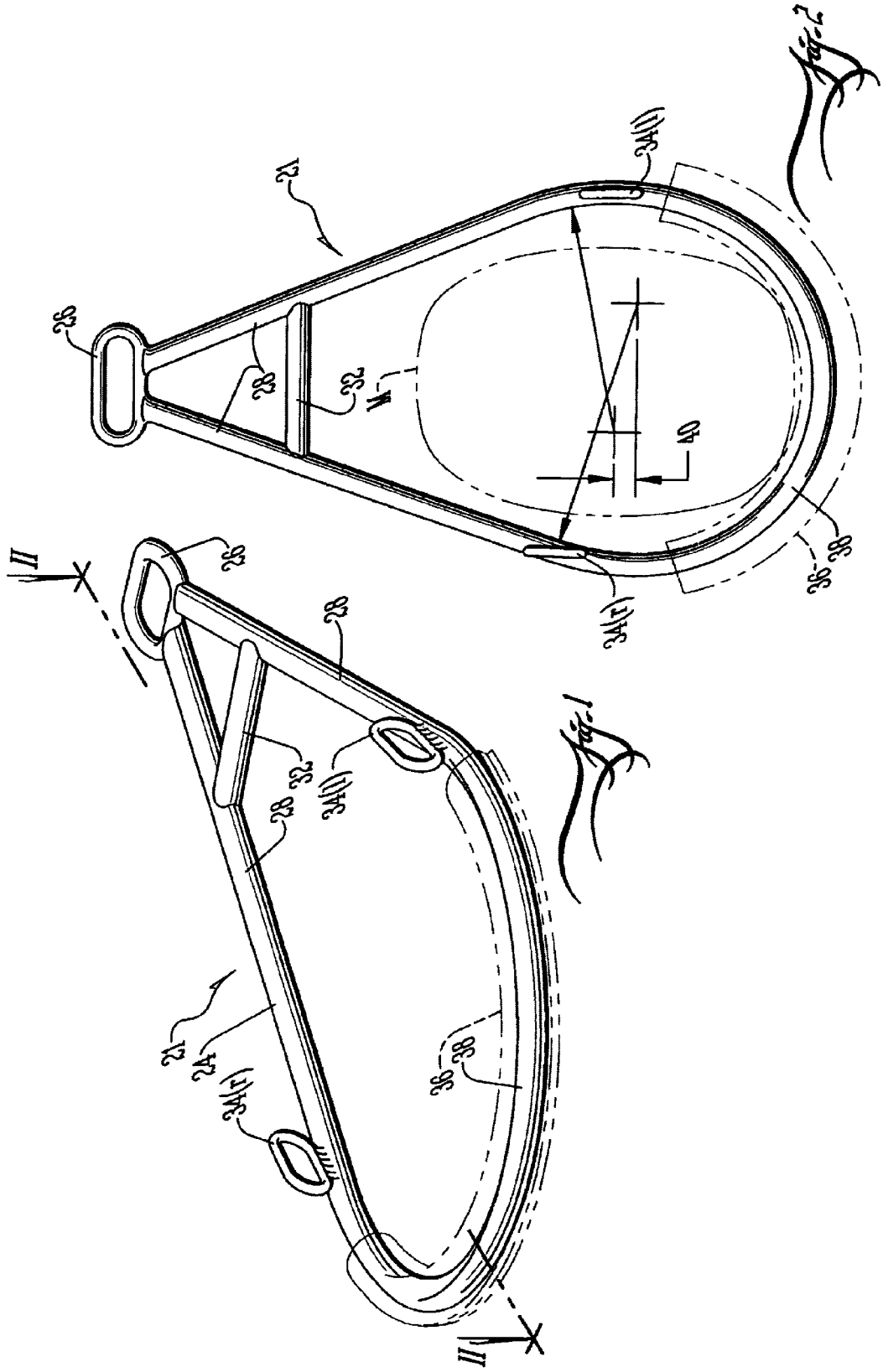
FIG. 1 is a perspective view of a rigid noseband in accordance with the invention for loosely suspending from harnessing headgear.
FIG. 2 is a top plan view thereof taken in the direction of arrows II—II, wherein a relative cross-sectional outline of a horse's muzzle is indicated in dashed lines.
Figure 3:
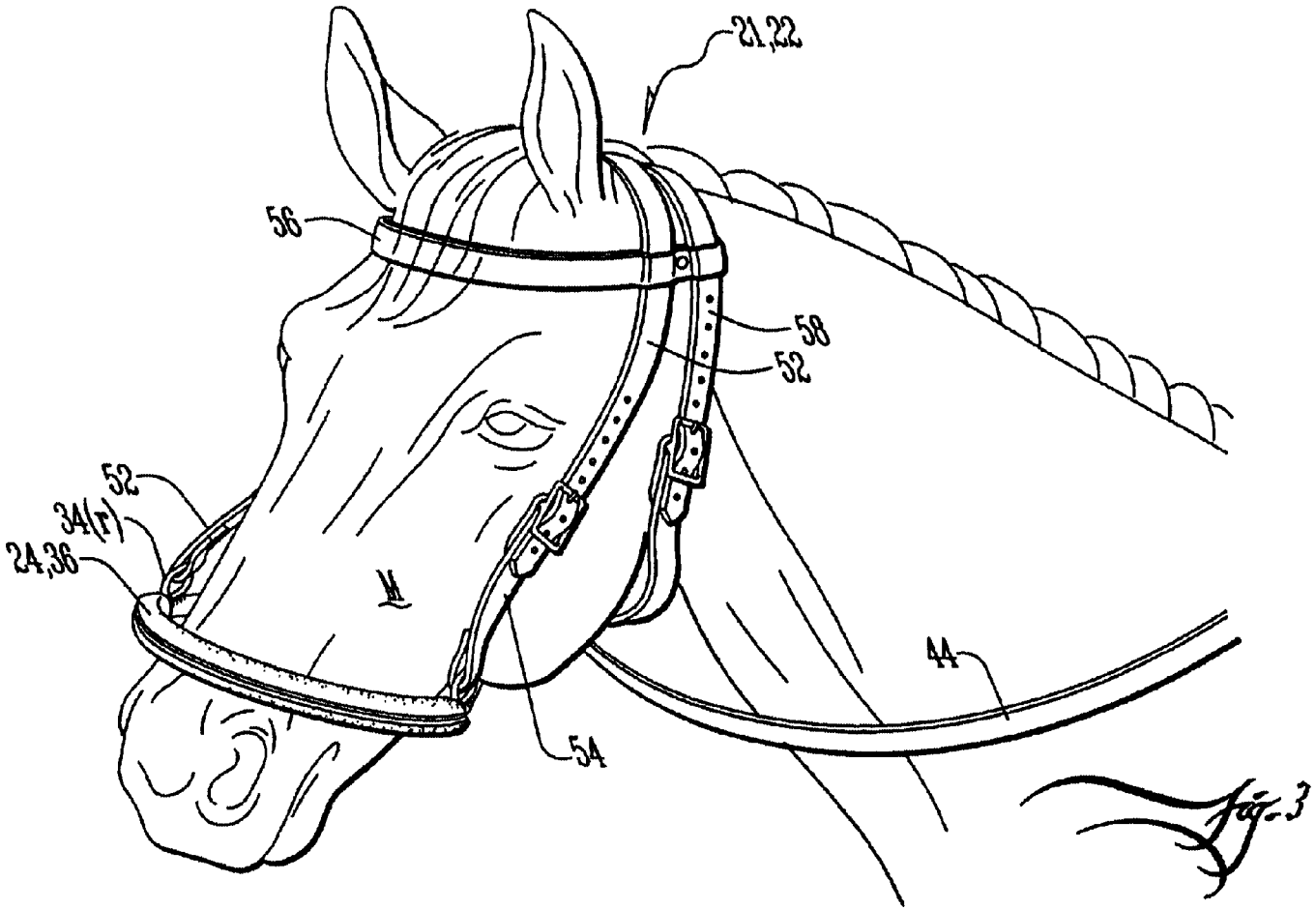
FIG. 3 is a perspective view of a combination training headstall and loose, rigid noseband in accordance with the invention and which combination is shown adorning a horse, portions of which are broken away.
Figure 4:
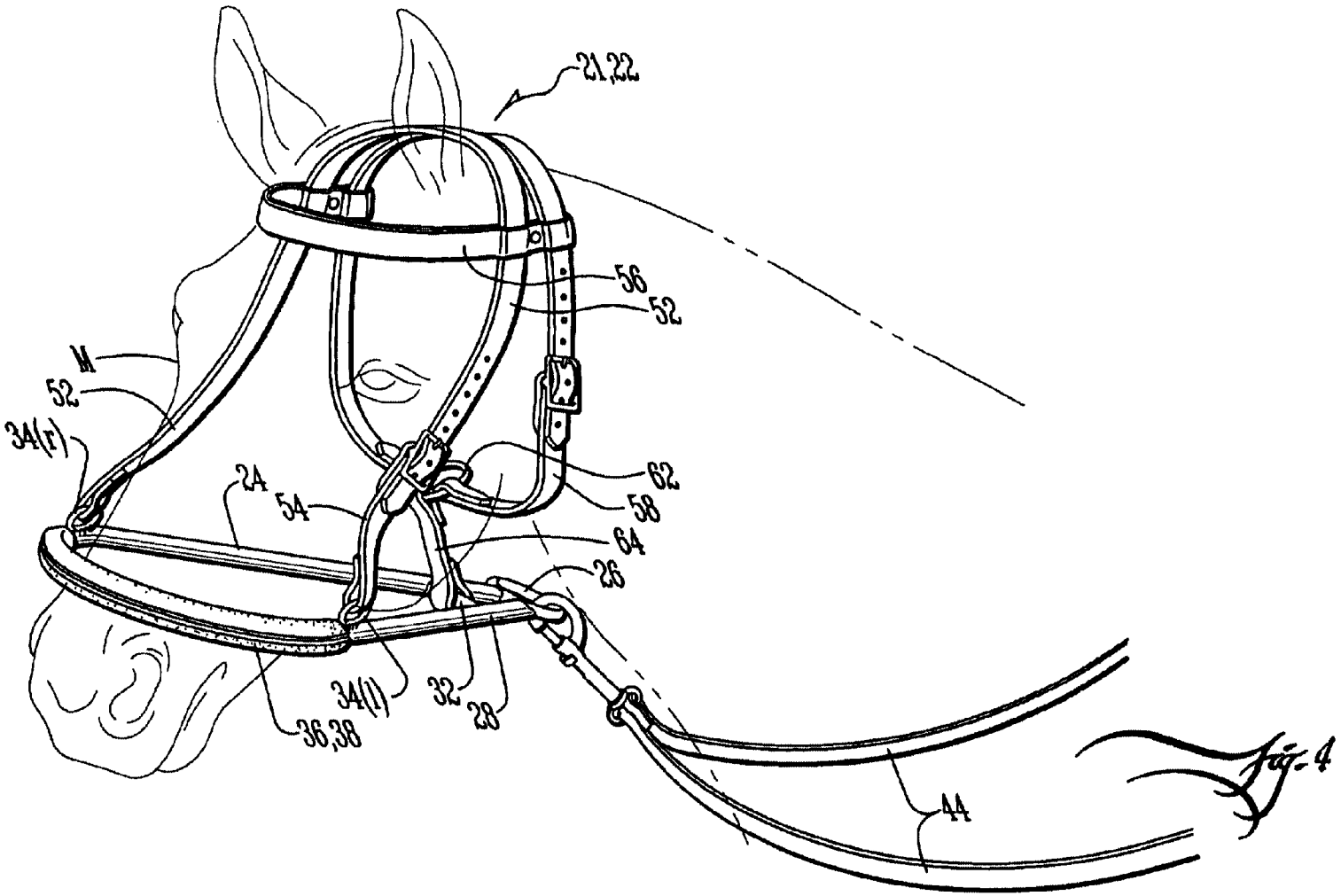
FIG. 4 is a view comparable to FIG. 3 except that the horse is shown in phantom.
Figure 5:
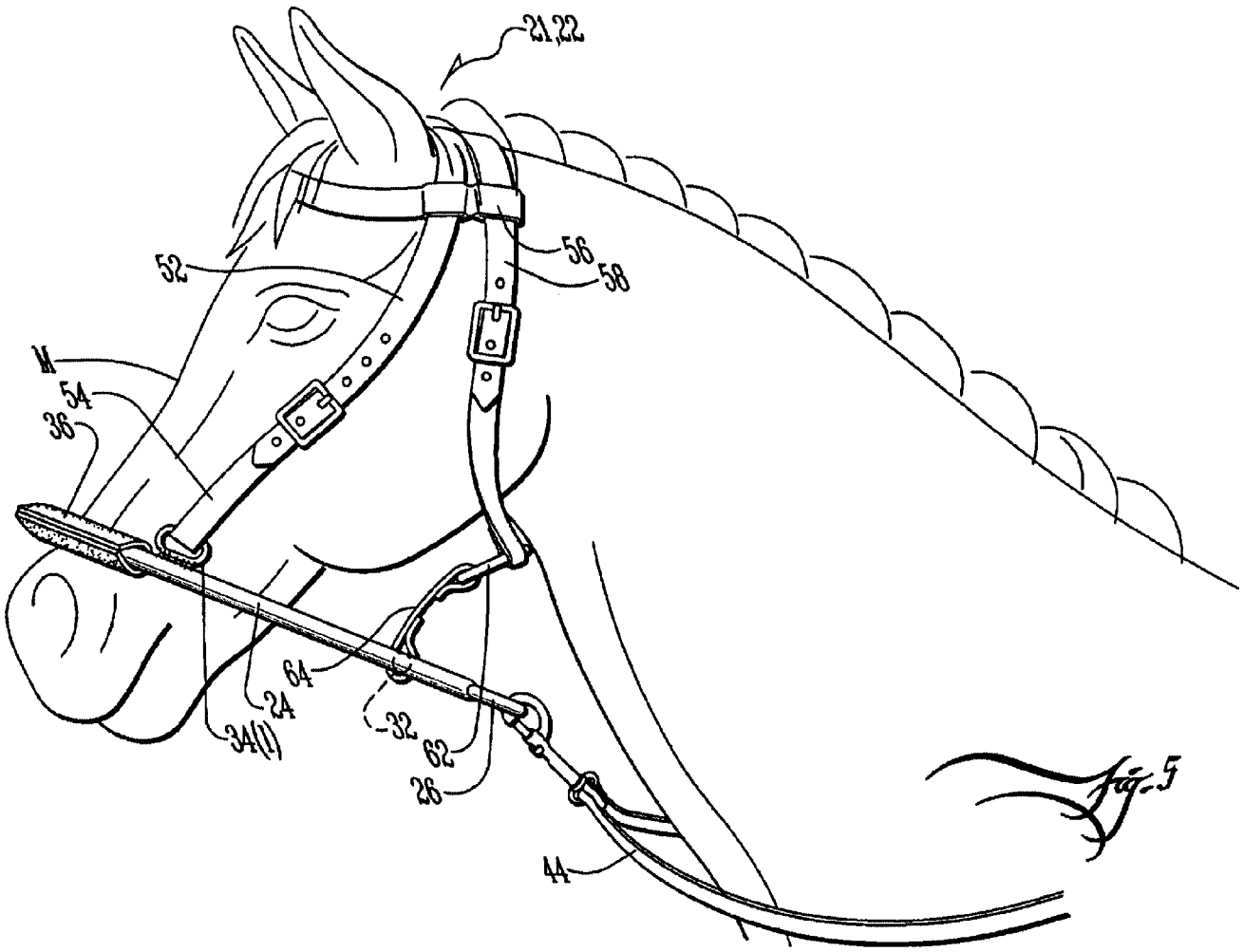
FIG. 5 is a side elevational view of FIGS. 3 or 4.

FIGS. 1 and 2 show a noseband product 21 in accordance with the invention for incorporation in a training headstall (see, eg., reference numeral 22 in FIGS. 3, 4 or 5). The noseband product 21 predominantly appears as a tear-drop shaped wicket 24 which, in a preferred embodiment of the invention, is preferentially produced from about a $7/16^{ths}$-inch (11 mm) diameter steel rod stock and formed by a production process more particularly described below. Alternatively, the wicket can be produced from $3/8^{ths}$-inch (9½ mm) diameter steel rod stock including horse-bit steel rod, as such steel stock is commonly referred to in the industry, and also formed by such production processes described more particularly below.

The noseband product 21 further comprises an oval rein hook 26 that provides a welded anchorage for the opposite legs or tag ends 28 of the wicket 24. A stop (or chin) bar 32 is disposed as shown between the left and right legs 28 of the wicket 24 and is attached by welding or the like. Left and right lobes 34(l) and 34(r) are secured to approximately the left and right extremes of the wicket 24.

More preferably, the left and right lobes 34(l) and 34(r) are not exactly symmetrically opposite each other but instead one lobe or the other is offset rearward of the other. As shown by FIGS. 1 or 2, the right lobe 34(r) nearest the horse's right cheek is offset about one inch (~2½ cm) rearward of the fixed position of the left lobe 34(l) that is nearest the horse's left cheek. A leather sleeve 36 is wrapped around and attached over an arch portion 38 of the wicket 24 as shown. The leather sleeve 36 is attached by use of overlapping, sewn seamed edges, and is better shown by any of FIGS. 5 or 3 and 4. The arch portion 38 is produced as the asymmetric semi-circle or half-hoop between the left and right lobes 34(l) and 34(r). That is, although the arch portion 38 is about half of a circle, it is 'about half' of an 'asymmetric' circle.

Consequently, referencing FIG. 2 once again, the tear-drop shaped wicket 24 is preferably formed so that its left and right lateral halves are not mirror opposites of each other but instead are asymmetric such as for example and without limitation as shown. In the example of FIG. 2, the left and right arch-to-leg transition portions of the wicket 24 are curved about the respective radial centers as indicated. The radial centers are offset from each other by the indicated gap 40. One way to achieve this shape is by the following process. At some original time, stock material for the wicket 24 is selected from straight and as yet unbent steel or iron rod, preferably $7/16^{ths}$-inch (11 mm) diameter steel rod (or alternatively $3/8^{ths}$ inch diameter horse-bit steel, which in metric corresponds to about 9½ mm). The straight stock material is characterized by a leading end followed by an indefinite length of straight tail (this is not illustrated). The stock material is optionally warmed or heated to facilitate bending such that the straight tail is bent around a fixture to give the wicket 24's arch 38 its shape. As the straight tail is bent around the fixture, the leading end comes progressively around in a semi-circle until it winds up converging back on the tail, being bent past 180° to about 220° in opposite direction from where the leading end started. At about where the leading end converges upon and nearly touches the tail, the stock material is cut and hence this produces the general shape of the wicket 24 with an arch 38 and two converging legs 28 as shown. The oval rein hook 26 is selected from suitable wire oval stock, and the wicket 24's opposite legs 28 by the very tag ends thereof are welded in place as shown.

It is an aspect of the invention that, as the straight tail is being bent around its fixture, the round rod stock is subjected to a concurrent corkscrewing process as follows. That is, as the tail is bent around the fixture, the leading end thereof is twirled or twisted about its axis (eg., corkscrewed). That way, the twirling or twisting of the leading end sets up an asymmetric warp or bulge in the arch portion 38 of the wicket 24 such that the wicket 24 is not perfectly symmetric. One example form and amount asymmetry is shown in FIG. 2 and with reference in particular to the indicated gap 40.

The foregoing process can be achieved in alternate ways and is worthy of further description briefly as follows. It is preferred to pre-heat the manufacturer-supplied round rod stock until sufficiently warm, indeed until it glows. The section of the round rod stock that will ultimately form the arch portion 38 (not yet formed) is twisted like a corkscrew. By this alternative process, the corkscrewing activity is performed while indeed the round rod stock remains relatively straight along its axial length. It has been discovered that this hot or cold "corkscrew" twisting of the round rod stock provides useful improvements in the performance of the noseband product 21. It is not known exactly what is accomplished by doing such corkscrewing to the rod except that, perhaps among other rationales the corkscrewing is estimated to remove the tempering from the round rod stock.

It has further been discovered that the desired results are achieved if only a section of the straight rod stock is corkscrewed:—so long as such a corkscrewed section ends up being used in formation of the arch portion 38.

Figure 7:
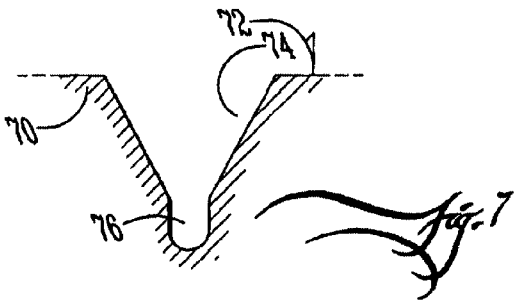
FIG. 7 is an enlarged sectional view taken along line VII—VII in FIG. 6; and, FIG. 8 is a comparable sectional view except taken along line VIII—VIII in FIG. 6, and broken away in the fading depth of the view.
Figure 8:
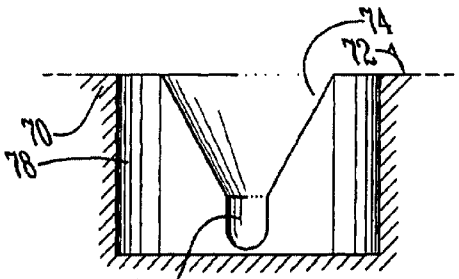
Figure 6:
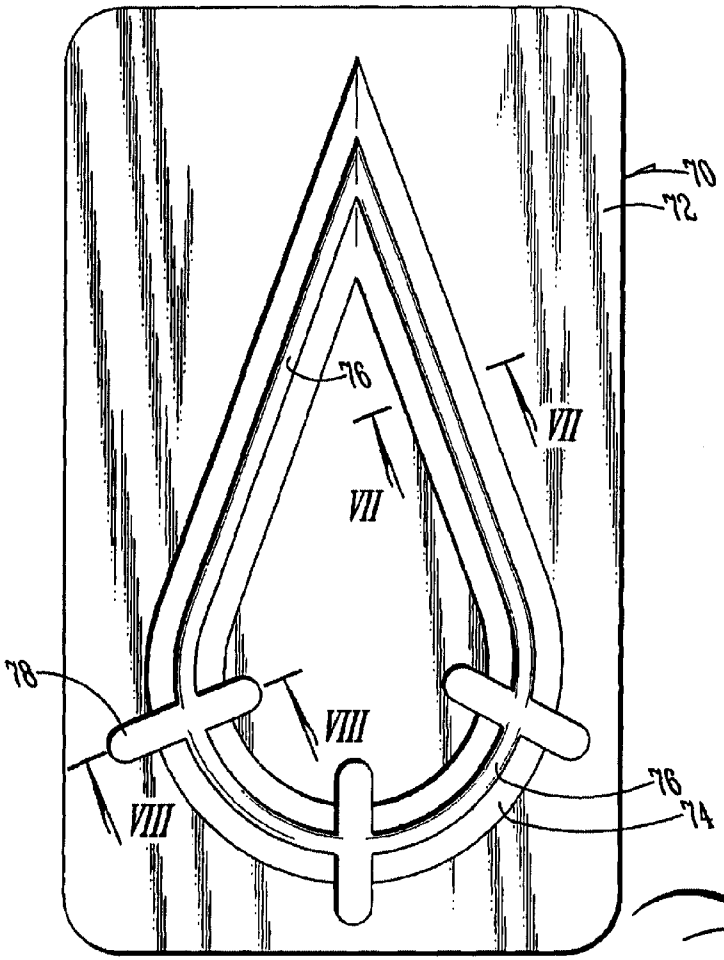
FIG. 6 is a top plan view of a table in accordance with the invention for forming the rigid noseband in accordance with the invention.

FIGS. 6 through 8 show a table 70 in accordance with the invention for forming the wicket 24 in accordance with the invention. The table 70 comprises a flat top 72 recessed with valley-shaped groove 74, the vertex of which forms a U-shaped trough 76 together which are shaped and arranged to receive the round rod stock of the wicket 24. At some original time before the round rod stock is introduced to the forming table 70, the round rod stock is pre-heated, its middle section corkscrewed as described above, then optionally re-heated to further soften the rod stock so that a worker can roughly shape the rod stock in very approximately the final preferred tear-drop shape of the wicket 24. Given the foregoing, a worker forces the rod stock downwardly in the valley-shaped groove 74 of the forming table 70. FIG. 7 is a section view taken along line VII—VII in FIG. 6 and shows how the sloping sides of the valley-shaped groove 74 funnel inwardly into the terminal U-shaped trough 76.

FIG. 8 is a comparable sectional view except taken along line VIII—VIII in FIG. 6, showing one of the three or so stake pockets 78 arranged transverse to the valley-shaped groove and U-shaped trough 74 and 76. The stake pockets 78 allow a worker to insert a driving stake (not shown) therein and hammer the soft relatively-hot rod stock to assume the final shape of the U-shaped trough 76. In consequence, the rod stock can be formed into a tear-drop shape of the end-product wicket 24 as desired.

The U-shaped trough 76 has a span and diameter chosen to closely fit around the chosen diameter of the round rod stock, whether that be a nominal outside diameter of $7/16^{ths}$-inch (11 mm), $3/8^{ths}$ inch (~9½ mm), or whatever. After hammering in the rod stock, it is allowed to harden and then extracted from the forming table 70, thus producing wickets 24 as desired.

In order to produce different sizes of wickets 24, different size tables 70 are needed corresponding to the final size of wicket 24 desired. Presently it is preferred to produce the wicket 24 in five sizes corresponding from large to small as follows:—draft horse size, regular size, yearling size, pony size and miniature pony size. The drawings show as representative of the all the other possible sizes what the inventor hereof considers regular size. Referring to FIG. 2, "regular" size corresponds to the following measurements. The wicket 24 measures from the arch portion 38 to rein hook 26 extremes (ie., the bottom to top extremes in FIG. 2) about fifteen inches (~38 cm). The wicket 24 measures from its left to right extremes (eg., somewhere along a horizontal axis through gap 40) about 7⅝ inches (~19 cm). As previously mentioned, the left and right lobes 34(l) and 34(r) are offset relative to one another, these lobes also alternatively being reckoned as strap eyes 34(l) and 34(r) (ie., being referenced as "strap eyes" for reasons more readily apparent with its function as more particularly described below in connection the description of the headgear harnessing 22). Thus in a preferred embodiment for a "regular" size wicket 24, the lobes or strap eyes 34(l) and 34(r) are offset such that the center of geometry of the right lobe 34(r) trails the center of geometry of the left lobe 34(l) by about ⅜-inch (~9½ mm), although in FIG. 2 the scale of this offset is greatly exaggerated for convenience of illustration.

The purpose for the asymmetry includes the following. In use, the headgear harnessing 22 (described more particularly below in connection with FIGS. 3, 4 or 5) suspends the wicket 24 freely in most cases and not necessarily touching the muzzle M of the horse. Indeed, FIG. 2 provides a representation in dashed lines M of the outline of a horse's muzzle, and thereby illustrates the loose fit of the wicket 24 relative the horse's muzzle M. Also, the headgear harnessing 21 generally suspends the wicket 24 so that it can remain level or incline freely somewhat independent of the horse tipping its head. A trainer holding reins (eg., 44 in FIGS. 3, 4 or 5) attached to the rein hook 26 can execute a restraint maneuver with the wicket 24 by snapping the reins 44. The reins 44 send the shock right up to the rein hook 26 which is felt there as an applied impulse. The impulse to the wicket 24 sends it in motion. The wicket 24 taps (or slaps) the horse on the muzzle. Needless to say the tap of the steel wicket 24 is something the horse does not ignore.

However, if the horse responds by freezing to a standstill, then it is an aspect of the invention to settle quickly. In other words, the invention is designed to tap once and then settle quickly for horses that stop to a standstill. Trial and error has found that among various ways to achieve quickly settling the motion of the wicket 24 includes incorporating various kinds of asymmetry in the design. Hence the design incorporates an asymmetric wicket 24, one which has its arch portion 38 corkscrewed in order to (eg.) remove the temper, as well as asymmetric location of the left and right strap lobes 34(l) and 34(r).

Isolating on the asymmetric wicket 24, an experiment with a truly semi-circular or otherwise 'symmetric' half-round wicket 24 would show that it would undesirably tend to "ring," like a bell. That is, an experiment with a truly semi-circular (eg., 'symmetric' half-round) wicket 24 would certainly find that it would resonate or oscillate or the like for some extended time span, although during which said ringing such ringing or oscillations would decay over some decay period.

Such virtual "ringing" is counter-productive for horse-training purposes. During horse-training, if the horse is acting up, the trainer wants to apply a tap, but that's it. The trainer wants the horse to associate a tap with a signal the response to which is to stop to a standstill. If the wicket continues to "ring" away and bang the horse a second or third time, it is feared that the horse will not be able to learn how to respond as desired to the signal but fight in ignorance to what seems like arbitrary abuse. The horse will not likely solve the riddle that one tap means standstill if responding with standing still does not immediately eliminate the annoyance of the tapping.

It is an aspect of the invention that the horse learns this lesson:—regardless that the application of the first tap is always within the power of the trainer, the causation of a second or third or successive taps are within the power of the horse if it just comes to a standstill after the first tap.

Accordingly, an asymmetric wicket 24 as discovered has desirable damping characteristics in that such an asymmetric wicket 24 appears not to "ring." That is, impulses given to an asymmetric wicket 24 appear to dampen to stillness much more quickly. Given the foregoing, the inventive wicket 24 is produced with at least three factors which are believed to distinguishably advance its performance to the preferred level of desirable performance achieved to date. Those three factors include (i) the asymmetric shape of the wicket 24, (ii) the corkscrewing during fabrication of the arch portion 38, which presumptively removes the temper off the steel stock or otherwise effectively deadens it, and (iii) the offset or asymmetric alignment of the of the left and right lobes 34(l) and 34(r). Again, it is an object of the invention that the wicket 24 tap once and then deaden, not tapping the horse again if the horse learns that it can avoid successive taps after the first by stopping to a standstill.

To look for a moment at the offset lobes or strap eyes 34(l) and 34(r), FIG. 2 shows that the center of geometry of the right lobe 34(r) trails the center of geometry of the left lobe 34(l) by some measure, or about ⅜-inch (~9½ mm) in a preferred embodiment for a "regular" size horse-training headstall 21 in accordance with the invention. This asymmetrical offset between the left lobe 34(l) and right lobe 34(r) is provided by design to avoid a balance rocking axis between the two lobes 34(l) and 34(r). That is, perfectly symmetrically opposite lobes 34(l) and 34(r) (not shown this way) would create a balanced rocking axis in the left-to-right direction. That way, the wicket 24 might rock front to back without settling very slowly. However, in accordance with the invention, the left and right lobes 34(l) and 34(r) are offset such that, as shown in FIG. 2, the right lobe 34(r) trails the left lobe 34(l). In consequence, there is no balanced rocking axis. The wicket 24 wobbles because it is deprived of a balanced rocking axis.

Given the foregoing, the various factors which promote the wicket 24 to settle quickly after an applied impulse include choosing from at least the three of (i) the asymmetric shape of the wicket 24, (ii) the corkscrewing during fabrication of the arch portion 38 which presumptively removes the temper off the steel stock or otherwise effectively deadens it, and (iii) the offset or asymmetric alignment of the of the left and right lobes 34(l) and 34(r). Again, it is an object of the invention that the wicket 24 tap once and then quickly settle, not tapping the horse again if the horse learns that it can avoid successive taps after the first by stopping to a standstill.

In practice, horses do indeed quickly learn to avoid any head shaking or wagging after receiving a tap as way of avoiding being further slapped around by the wicket 24.

If the wicket 24 doesn't settle to avoid a second tap for a horse which properly stops to a standstill after the first tap, then the hoped-for lesson to teach the horse is lost. The bedevilment inflicted by any wicket 24 that taps more than once (for a stationary horse) is too arbitrary for the horse. Horses don't respond well to poorly designed training headgear which don't tap once and settle (again, for horses stopped to a standstill). Horses just don't seem to learn to solve the puzzle of how to stop the slapping of a poorly designed training headgear which is more complicated than tap once and settle.

FIGS. 3, 4 and 5 show the headgear harnessing 22 in accordance with the invention for the distinctive combination training headstall 22 and loose, rigid noseband 21 of the invention. The headstall 22 includes a crown strap 52 extending from an origin secured to the right-side lobe or in other words a strap eye 34(r) of the wicket 24 (ie., "right" relative the horse's right side) to terminate in a tag end formed with catch holes for mating with a buckle secured on the tag end of a cheek strap 54 having an origin attached to the left-side lobe or strap-eye 34(l) of the wicket 24. The crown strap 52 intersects and mates with a brow band 56 as shown. The brow band 56 forms an arch around the horse's forelock to terminate in two ends which attach to a buckled throat latch 58 as shown. FIGS. 4 and 5 show that the throat latch 58 loops around in a circuit from opposite origins in a steel ring 62. Extending between this steel ring 62 and the stop bar 32 of the wicket 24 is a short hobble strap 64.

The headstall 22 is variously adjustable. Among other adjustments, the buckle arrangement for the crown and cheek strap 52 and 54 permit fitting the wicket 24 on a range of sizes of horse (within given extremes), as well as allow varying the positioning of the wicket 24 on a given horse. For instance, experience teaches that for the same applied impulse at the rein hook 26, the wicket 24 tends to slap the horse harder if the wicket 24 is looser on the horse. Hence positioning the wicket 24 lower down the muzzle of the horse provides for a looser fit and hence affords opportunity for more severe restraint measures. Positioning the wicket 24 relatively up the horse's muzzle M towards the brow tends to lessen the severity of control and limits the contact to relatively lighter tapping.

Pause can be taken to consider various usages and advantages of the invention. One aspect of the invention is that it shortens the ground-work phase of breaking a horse to less than an hour, and preferably to about equal to or less than a half hour. Truly the inventor hereof has provided ample demonstration of riding a previously-unbroken horse within an hour, even if the horse is not even as much as halter-broken.

The loose-fitting wicket 24 quickly teaches the horse to hold at a standstill. A first-time wearer learns quickly that the only way to eliminate the slapping of the wicket 24 is to stand motionless. The arch portion 38 is covered in the leather sleeve 36 to provide cushioning and protect the horse from cuts and bruises. The wicket 24's weight is chosen from balancing the one consideration of being sufficiently heavy to command a wild horse's attention against the competing consideration of not inflicting real hurt. The wicket 24's size or more particularly, oversize, is chosen from like competing considerations. In addition, the oversize is advantageous for allowing some accommodation of different size horses as well as some adjustability for a given size horse. Elevating the wicket 24 to fit higher up on the muzzle M in the direction of the horse's brow provides for gentler instruction with a horse having a gentler nature to begin with.

An advantage of the invention is that it obviates the reliance on bits all together. Eliminating bits is ideal because a lot of hurt is inflicted by bits during the ground-work phase of breaking a horse. Typically, techniques relying on bits might see a two (2) week or so ground-work phase. Bits at this phase of breaking a horse commonly stress a horse unduly. Bits bust up the horses tongue, which leaves it nursing injuries. The horse can't eat right, it may even lose weight which further adds to the stress.

The invention is a distinct improvement over the prior art way of breaking a horse. The goal of groundwork is gain respect without applying abusive technique, and certainly not corporal punishment by switches or the like. Experience teaches that by abbreviating the groundwork as shortly as possible also eliminates the opportunity for a horse to develop bad habits from a lengthy period of being trained by a lead chain.

The wicket 24 provides various aspects of the structure and advantages of the invention as follows. The wicket 24 prevents bucking. When a horse bucks, to do this it tips its head down as between its legs. With the wicket 24, the horse's chin hits the stop (or chin) bar 32. The inventor has found that such contact like that is enough of a deterrent. Indeed, once mounted, the trainer is afforded the opportunity to pull up on the reins 44 and bring the stop bar 32 to bear under the horse's chin. The trainer can pull with more or less force as needed to gain the respect of the horse and deter bucking.

Again, the wicket 24 as incorporated in the inventive combination 21,22 is advantageous for shortening the groundwork phase of breaking a horse. Significant design aspects of the wicket 24 includes the design of the wicket 24's swing on the headstall 22. If the trainer wants to have the horse come forward, the trainer can do from a position standing on the ground. The trainer stands in a position generally in front of the horse, and from there snaps the reins 44 to induce a swing in the wicket 24 (not side-to-side but back-to-front). In the forward portion of the swing, the stop or chin bar 32 first swings up to tap the horse under its chin, then the wicket swings back until the arch portion 38 taps the horse on the top of its snout. A horse's nature is, if a trainer can tip the horse's head down, the horse comes forward. By the foregoing maneuver, with a tap on the top of the snout the horse indeed is commonly expected to tip its head down. The horse also learns through rapid trial and error that a certain response to settle the swinging wicket 24 to a standstill is to not only tip its head down but come forward.

Another maneuver for the trainer on the ground has the trainer standing on the ground relatively alongside the horse's back, or relatively behind the rein hook 26 of the wicket. Here is where the trainer works on problems with a scared horse. The trainer can pull the rein hook 26 back, down or sideways and cause the horse to change stance a pace or two. But as the horse shifts stances, the wicket 24 taps the horse here and there, the startling effect of which generally causes the horse to come again to a standstill. Now the trainer can rub and pet the horse and get it accustomed to tactile, positive feedback supplied by the trainer. The trainer thereby soothes the fear and apprehension out of the horse. Again, the wicket 24 is designed so that if set into a swinging motion, the swinging dampens quickly. An important lesson for the horse to learn is that it, the horse, has control over making the startling or disagreeable tapping go away by coming to a standstill.

The trainer works this way with the horse for about a half hour or so with this start and stop technique. That is, lead the horse forward a pace or a few and then stop. Shift the horse to the side a pace or a few and then stop. Pet, rub, converse with and otherwise soothe the horse until the level of agitation is reduced because the horse has learned that, one, there is new factor in its life it doesn't like (ie., the startling taps of the wicket 24), in combination with two, the horse can eliminate the new factor by halting to a standstill. Bucking, head shaking and jerking away are deterred because those activities only worsen the startling and disagreeableness of the wicket 24. The only remedy for the disagreeableness of the wicket 24 is to simply come to a standstill.

Distinct aspects of the wicket 24 relate to its positioning and balance as adjusted by the headstall 22. FIG. 5 shows that relative adjusting among the crown and cheek straps 52 and 54 relative to the throat latch 58 allows positioning the relative levelness or incline of the wicket 24 in reference to the muzzle M. The wicket 24 more or less can pivot about a hinge axis either through the outer lobes 34(l), 34(r), or stop bar 32, depending on how much head shaking or rein snapping is exciting the motion. Slackening the strapping permits more hinge motion whereas tightening the slackening restrains the hinge motion. Trial and error teaches that each variation has advantages dependent on the response of the horse thereto.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

I claim:

1. A training headstall comprising:

a rigid wicket having an intermediate arch portion extending between spaced transitions into left and right leg portions which extend remotely from the arch portion to commonly connect with a given structure adapted for attachment thereto of either reins or a handline;

said wicket being provided with left and right line-eyes located at or approximately at the respective transitions into the left and right leg portions;

headgear for adorning a horse's head and suspending the wicket around the horse's muzzle, said headgear including left and right lines for attaching to the left and right line-eyes and an additional line for attaching to the given structure;

said wicket being sized to fit loosely around the horses muzzle and thus the left and right headgear lines afford the wicket some measure of freedom of movement about the horse's muzzle as the additional line affords some measure of constraint on that freedom of movement;

said wicket further being formed laterally asymmetric relative an imaginary plane of approximate symmetry through the horse's head in order to promote, after being set in motion, quicker settling of the motion if the horse learns to stop to a standstill.

2. The training headstall of claim 1 wherein the given structure comprises a base member that defines a transverse chin bar for the wicket and affords attachment for said additional line, and further comprises at least another member supporting a rearwardly spaced an eye affording attachment for either the reins or handline.

3. The training headstall of claim 1 wherein said left and right line-eyes are arranged offset relative to each other and as referenced along a general front-to-rear axis in order to further promote, once the wicket is set in motion, quicker settling of the motion if the horse learns to stop to a standstill.

4. The training headstall of claim 1 wherein the arch and leg portions of the wicket are produced from a single piece of steel rod stock at least for weight purposes.

5. The training headstall of claim 4 wherein the arch portion of the wicket is produced by a process by which the steel rod stock was heated and twisted in corkscrew-fashion for the presumed purpose to deaden the ability of the end-product wicket to ring lively, and improving instead the ability of the end-product wicket to dissipate any clanging with rapid decay.

6. A method of instructing horse training techniques comprising utilizing a training headstall according to claim 1.

7. A training headstall comprising:

headgear for adorning a horse's head and providing three flexible suspension lines including left and right lines hanging approximately alongside the left and right sides of the horse's muzzle and a chin line hanging approximately under the horse's chin to throat area; and a rigid oblong hoop being generally elongated along a major axis that partitions the hoop in generally left and right sides, said hoop having left and right provisions on opposed sides of the major axis for attachment of the left and right headgear lines in order to suspend the hoop around the horse's muzzle, wherein said hoop is sized to fit relatively loosely around the horse's muzzle which affords the hoop some measure of freedom of movement about the muzzle as suspended by the left and right lines;

said hoop further having a chin-line attachment provision toward a general rearward portion of said hoop for attachment of the chin line thereto in order to provide optional adjustment of the angle of tilt of the hoop relative the horse's muzzle as well as to impose a measure of constraint on the motion of the hoop about the horse's muzzle once set in motion;

wherein said hoop is laterally asymmetric relative a plane that both contains the major axis and is perpendicular to another plane which generally contains the hoop in order to enhance quicker settling of motion if the horse learns to stop to a standstill.

8. The training headstall of claim 7 further comprising either reins or a handline attached to the hoop, either of which provides a standing or mounted user with control over the hoop through use of the reins or handline.

9. The training headstall of claim 8 further comprising a user-line attachment provision located spaced from and generally rearward of the chin-line attachment provision.

10. The training headstall of claim 8 wherein:

said hoop includes a chin bar extending generally transverse to the major axis between opposite ends that are fixed at respectively spaced points on the hoop and which provides for attachment of the chin line thereto, and said hoop further includes a user-line attachment provision, for attachment of either the reins or handline thereto, and located spaced and generally rearward of the chin bar.

11. The training headstall of claim 7 wherein said left and right line-attachment provisions are arranged offset relative to each other and as referenced along the major axis in order to further enhance quicker settling of the motion with the hoop so that the horse may more surely learn that such motion can be settled by stopping to a standstill.

12. The training headstall of claim 7 wherein the hoop is produced from steel rod stock.

13. The training headstall of claim 12 wherein the hoop includes a forward curved portion extending generally between the left and right line-attachment provisions, which forward curved portion is produced by a process by which the steel rod stock was twisted in corkscrew-fashion presumptively for deadening the ability of the end-product hoop to ring lively, and of improving instead the ability of the hoop to dissipate any clanging with rapid decay.

14. A method of instructing horse training techniques comprising utilizing a training headstall according to claim 7.

15. A training headstall comprising:

headgear for adorning a horse's head providing left and right hanging lines on opposite sides of the horse's muzzle and a chin line hanging approximately under the horse's chin to throat area; and a rigid noseband being generally oblong along a major axis that partitions the noseband in generally left and right sides, said noseband having left and right provisions on opposed sides of the major axis for attachment of the left and right hanging lines in order to suspend the noseband around the horse's muzzle, wherein said noseband is sized to fit loosely around the horse's muzzle and consequently is afforded some measure of freedom of relative movement on the left and right hanging lines, whereby said freedom of movement includes the ability to deliver the horse an attention-getting tap;

said noseband further having a chin-line attachment provision toward a general rearward portion of said noseband for attachment of the chin line thereto in order to impose a measure of damping on the motion of the noseband about the horse's muzzle once set in motion;

wherein said left and right line-attachment provisions are arranged offset relative to each other and as referenced along the major axis in order to enhance quicker settling of the motion with the noseband so that the horse may more surely learn that such motion can be settled by stopping to a standstill.

16. The training headstall of claim 15 further comprising either reins or a handline attached to the noseband, either of which provides a user with control to deliver or assist settling of attention-getting movement with the noseband.

17. The training headstall of claim 16 further comprising a user-line attachment provision located spaced from and generally rearward of the chin-line attachment provision for attachment of either the reins or handline.

18. The training headstall of claim 15 wherein said noseband is laterally asymmetric relative a plane that both contains the major axis and is perpendicular to another plane which generally contains the noseband in order to further enhance quicker settling of motion if the horse learns to stop to a standstill.

19. The training headstall of claim 15 wherein said noseband is produced from steel rod stock and includes a forward curved portion extending generally between the left and right line-attachment provisions, which forward curved portion is produced by a process by which the steel rod stock was twisted in corkscrew-fashion presumptively for changing the inherent ability of rod stock to ring lively to become deadened such that any clanging with the end-product noseband decays rapidly.

20. A method of instructing horse training techniques comprising utilizing a training headstall according to claim 15.

* * * * *